US009609420B2

(12) United States Patent
Azmi et al.

(10) Patent No.: US 9,609,420 B2
(45) Date of Patent: Mar. 28, 2017

(54) EARPHONES WITH LEFT/RIGHT MAGNETIC ASYMMETRY

(71) Applicant: Apple Inc., Cupertino, CA (US)

(72) Inventors: Yacine Azmi, San Jose, CA (US); Esge B. Andersen, Campbell, CA (US)

(73) Assignee: Apple Inc., Cupertino, CA (US)

( * ) Notice: Subject to any disclaimer, the term of this patent is extended or adjusted under 35 U.S.C. 154(b) by 267 days.

(21) Appl. No.: 14/151,583

(22) Filed: Jan. 9, 2014

(65) Prior Publication Data

US 2015/0195639 A1 Jul. 9, 2015

(51) Int. Cl.
*H04R 1/10* (2006.01)
*H04R 1/06* (2006.01)

(52) U.S. Cl.
CPC ..... *H04R 1/1058* (2013.01); *H04R 1/1033* (2013.01); *H04R 1/1041* (2013.01); *H04R 1/06* (2013.01); *H04R 1/1016* (2013.01); *H04R 1/1075* (2013.01); *H04R 2420/07* (2013.01); *H04R 2460/03* (2013.01)

(58) Field of Classification Search
CPC ..... H04R 1/06; H04R 1/1016; H04R 1/1033; H04R 1/1041; H04R 1/1058; H04R 1/1075; H04R 2420/07; H04R 2460/03
USPC ..... 381/74, 374, 401, 412, 421; 174/68.3
See application file for complete search history.

(56) References Cited

U.S. PATENT DOCUMENTS 6,035,052 A 3/2000 Fujihira et al.
7,317,810 B2 1/2008 Ohashi
7,873,180 B2 1/2011 Vercelli et al.
8,189,843 B2 5/2012 Harper
8,891,798 B1 11/2014 Laffon de Mazieres et al.
2011/0108304 A1 5/2011 Rothbaum
2013/0129110 A1* 5/2013 Harper ..... H04R 1/1041 381/74

FOREIGN PATENT DOCUMENTS

KR 20050018242 A 2/2005
WO WO-2007081072 A1 7/2007
WO WO-2013075098 A1 5/2013

OTHER PUBLICATIONS

PCT International Search Report and Written Opinion (dated Mar. 17, 2015), International Application No. PCT/US2014/070930, International Filing Date—Dec. 17, 2014, (11 pages).
PCT International Preliminary Report on Patentability, dated Jul. 21, 2016, Application No. PCT/US2014/070930.

* cited by examiner

*Primary Examiner* — Vivian Chin
*Assistant Examiner* — Friedrich W Fahnert
(74) *Attorney, Agent, or Firm* — Blakely, Sokoloff, Taylor & Zafman LLP

(57) ABSTRACT

A first earphone of an earphone system includes a first magnet assembly and a first voice coil. A second earphone of the earphone system includes a second magnet assembly and a second voice coil. The second magnet assembly has a magnetic polarity that is opposite to the first magnet assembly. The current direction in the second voice coil is reversed relative to the current direction in the first voice coil. The first earphone and the second earphone attract each other because of the opposite magnetic polarity between the first magnet assembly and the second magnet assembly.

13 Claims, 5 Drawing Sheets

EARPHONES WITH LEFT/RIGHT MAGNETIC ASYMMETRY

FIELD

Embodiments disclosed herein relate generally to electronic devices, and more specifically to earphone systems.

BACKGROUND

Whether listening to an MP3 player while traveling, or to a high-fidelity stereo system at home, consumers are increasingly choosing earphones for their listening pleasure. Earphones are a pair of small loudspeakers that are designed to be held in place close to a user's ears. Earphones are also known as earspeakers and headphones. The alternate in-ear versions are known as earbuds or earpods. Earphones either have wires for connection to a signal source such as an audio amplifier, radio, CD player, portable media player, mobile phone, or electronic musical instrument, or have a wireless receiver, which is used to pick up signals without using a cable.

Most common types of speakers used in earphones have a housing that contains a moving coil driver. The moving coil driver consists of a stationary permanent magnet element affixed to the frame of the earphone which sets up a static magnetic field, and a diaphragm attached to a coil of wire (voice coil) that is immersed in the static magnetic field of the stationary magnet. The diaphragm is actuated by the attached voice coil when the varying current of an audio signal is passed through the coil. The alternating magnetic field produced by the current through the coil reacts against the static magnetic field, in turn causing the coil and attached diaphragm to move the air, thus producing sound.

An earphone system often includes a left earphone and a right earphone. Conventionally, an earphone system is designed such that the drivers of the left and right earphones are essentially identical so that they respond similarly to the same audio signal.

SUMMARY

It is difficult to organize and store the left and right earphones of an earphone system as a combined unit, especially for an earphone system consisting of earbuds. An efficient mechanism is needed to organize and store the left and right earphones of an earphone system.

An embodiment of the present invention is an earphone system that includes a left earphone and a right earphone. The magnet assemblies or magnet systems of the left earphone and the right earphone are polarized with asymmetry, i.e., the magnet assembly of the left earphone has a magnetic polarity that is opposite to that of the magnet assembly of the right earphone. Because of the opposite magnetic polarities, the earphones will attract each other such that, for example in the case of symmetrical earphone housings, the same sides of the two earphone housings could come into contact with each other and be held in that position to in effect form a single unit. This is beneficial for their storage as a combined unit. In addition, the direction of coil current in the left earphone is opposite to that in the right earphone. The similarity in acoustic performance between left and right is thus preserved.

In one embodiment, an earphone system includes a first earphone and a second earphone. The first earphone and the second earphone of the earphone system are connected to an audio source. The first earphone includes a first magnet assembly and a first voice coil. The second earphone includes a second magnet assembly and a second voice coil. The second magnet assembly has a magnetic polarity that is opposite to the first magnet assembly. The current direction in the second voice coil is reversed relative to the current direction in the first voice coil. The first earphone and the second earphone attract each other when, for example, the front side of the first earphone is placed close to the front side of the second earphone. The first earphone and the second earphone could also attract each other when the back side of the first earphone is placed close to the back side of the second earphone.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1:
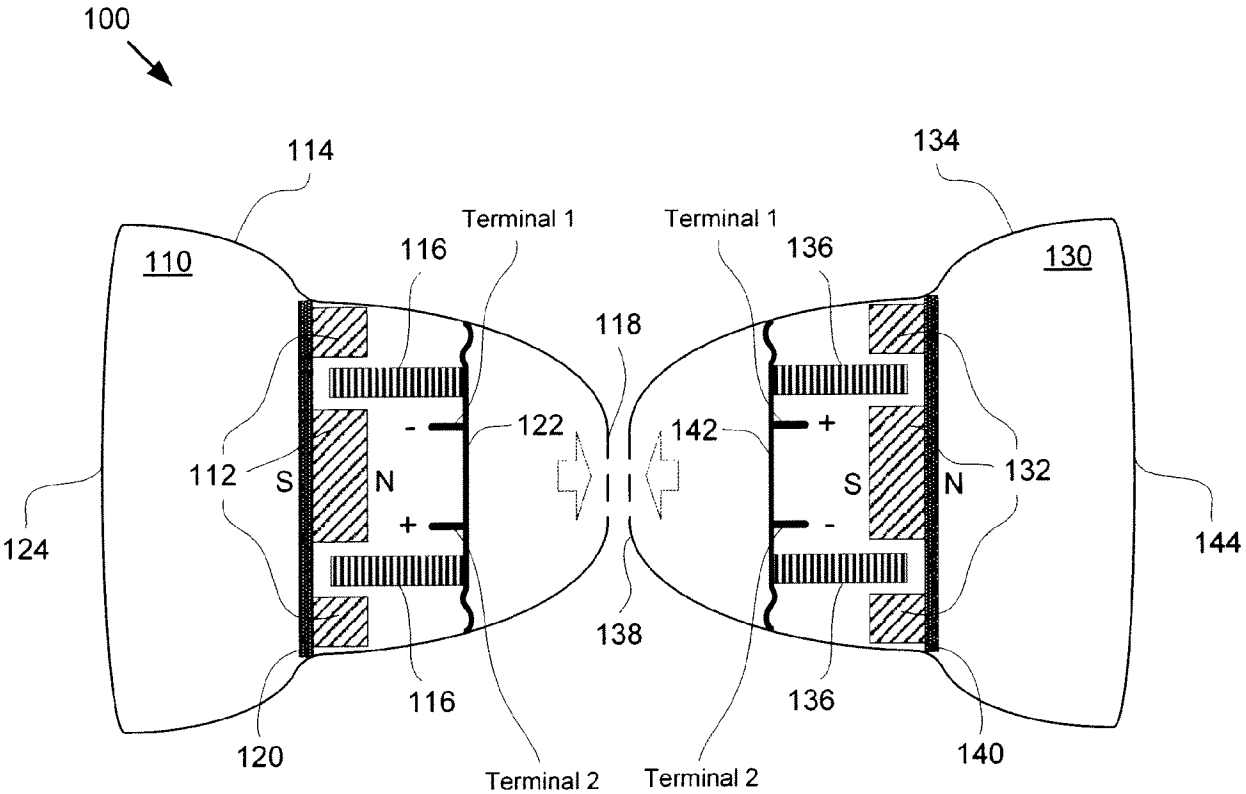
FIG. 1 illustrates a cross-sectional side view of an earphone system with a pair of asymmetrical magnetic polarity earphones that are facing opposite directions.

FIG. 1 illustrates a cross-sectional side view of an earphone system with a pair of asymmetrical magnetic polarity earphones that are facing opposite directions in accordance with one embodiment of the present invention. Specifically, this figure shows an earphone system 100 that includes a left earphone 110 and a right earphone 130. The front side of an earphone is the side of its earphone housing that is in the ear canal when the earphone is worn by a user. The back side of an earphone is the side of its earphone housing that is outside of the ear canal when the earphone is worn by a user. As illustrated in FIG. 1, the front side 118 of the left earphone 110 is placed adjacent to the front side 138 of the right earphone 130.

The left earphone 110 has a magnet assembly 112 and a voice coil 116 inside a housing 114. The magnet assembly 112 is affixed to a stationary component 120 of the left earphone 110 and sets up a static magnetic field to drive the voice coil driver of the left earphone 110. The voice coil 116 is attached to a diaphragm 122. An audio signal drives the voice coil 116 through terminals 1 and 2. The diaphragm 122 is actuated when the varying current of an audio signal is passed through the voice coil 116. The alternating magnetic field produced by the current through the voice coil 116 reacts against the static magnetic field generated by the magnet assembly 112 and in turn causes the voice coil 116 and attached diaphragm 122 to move the air, thus producing sound.

The right earphone 130 has a magnet assembly 132 and a voice coil 136 inside a housing 134. The magnet assembly 132 is affixed to a stationary component 140 of the right earphone 130 and sets up a static magnetic field to drive the voice coil driver of the right earphone 130. The voice coil 136 is attached to a diaphragm 142. An audio signal drives the voice coil 136 through terminals 1 and 2. The diaphragm 142 is actuated when the varying current of an audio signal is passed through the voice coil 136. The alternating magnetic field produced by the current through the voice coil 136 reacts against the static magnetic field generated by the magnet assembly 132 and in turn causes the voice coil 136 and attached diaphragm 142 to move the air, thus producing sound.

As illustrated in the example of FIG. 1, in the left earphone 110 the south pole to north pole direction of the magnet assembly 112 points to the front side 118 while in the right earphone 130 the south pole to north pole direction of the magnet assembly 132 points to the back side 144. The magnetic polarity of the magnet assembly 132 of the right earphone 130 is thus opposite to that of the magnet assembly 112 of the left earphone 110.

Because of the opposite magnetic polarity between the magnet assembly 112 of the left earphone 110 and the magnet assembly 132 of the right earphone 130, the left earphone 110 and the right earphone 130 attract each other when their front sides 118 and 138 are adjacent to each other, as illustrated in FIG. 1. The magnetic attraction between the left earphone 110 and the right earphone 130 could facilitate the storage of the left and right earphones as a combined unit. In one embodiment, in order to enhance the magnetic attraction between the left earphone 110 and the right earphone 130, the magnet assembly 112 is placed close to the front side 118 of the left earphone 110 and the magnet assembly 132 is placed close to the front side 138 of the right earphone 130.

The left earphone 110 and the right earphone 130 need to react to an audio signal in the same way, in order to have the same acoustic effect. Because of the opposite magnetic polarity between the magnet assembly 112 of the left earphone 110 and the magnet assembly 132 of the right earphone 130, the direction of coil current also needs to be opposite at the voice coil level, for the left earphone 110 and the right earphone 130. This is achieved in the embodiment of FIG. 1 and FIG. 2 as follows: in the left earphone 110, terminal 1 connects to the negative side of the audio signal, and terminal 2 connects to the positive side of the audio signal, while in the right earphone 130, terminal 1 connects to the positive side of the audio signal and terminal 2 connects to the negative side of the audio signal. The voice coil 116 of the left earphone 110 and the voice coil 136 of the right earphone 130 have the same coil winding direction. See FIG. 2 which illustrates the earphones of FIG. 1 while facing the same direction having opposite voice coil current directions (when driven by the same audio signal, for example). By showing the earphone system 100 this way, it is easier to illustrate the opposite voice coil level polarity (or opposing voice coil current direction) between the left earphone 110 and the right earphone 130.

Figure 2:
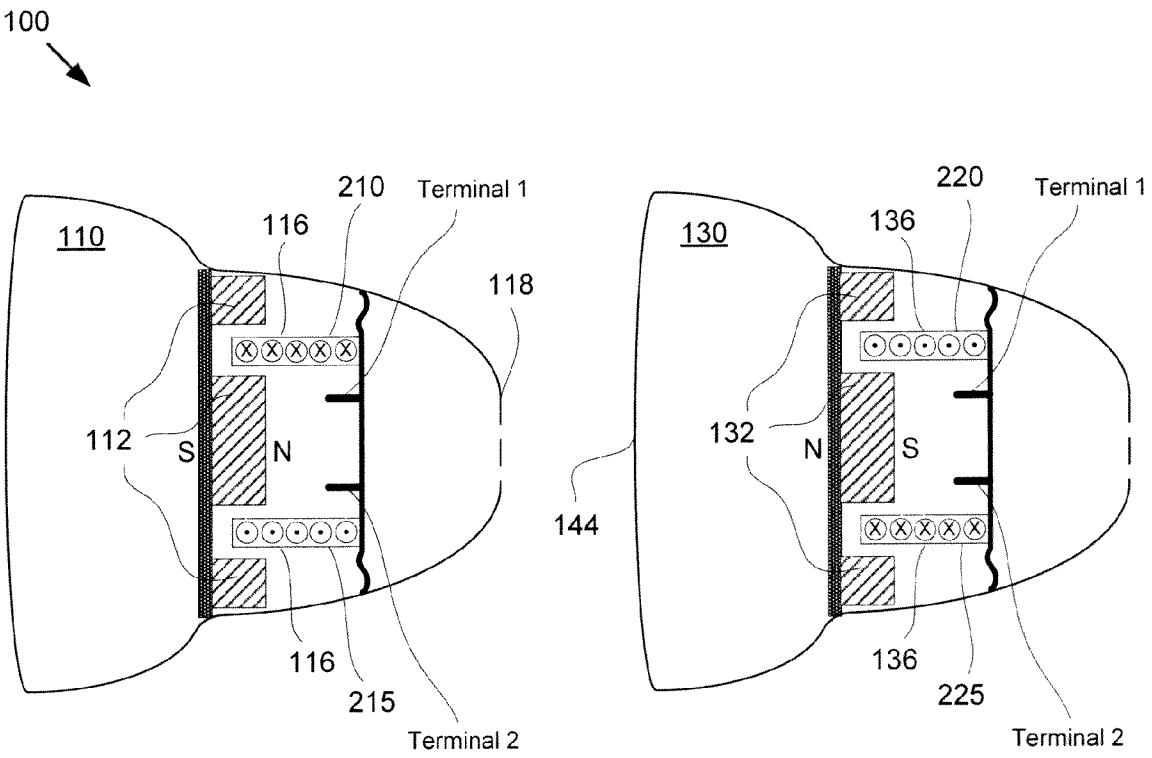
FIG. 2 illustrates the earphones of FIG. 1 facing the same direction.

As discussed above, the left earphone 110 and the right earphone 130 need to react to an audio signal the same way in order to have the same acoustic effect. Because of the opposite magnetic polarity between the magnet assembly 112 and the magnet assembly 132, the audio signal polarity also needs to be opposite at the voice coil level for the left earphone 110 and the right earphone 130. This opposite polarity at the voice coil level is achieved by reversed current directions in the voice coils 116 and 136. As shown in FIG. 2, the current direction in the voice coil 116 flows as if the current goes into the cross-section plane at the top section 210 and comes out of the cross-section plane at the bottom section 215, while the current direction in the voice coil 136 flows as if the current goes into the cross-section plane at the bottom section 225 and comes out of the cross-section plane at the top section 220.

In one embodiment, the reversed current directions in the voice coils 116 and 136 are achieved by having the same winding direction for voice coils 116 and 136, but the audio signal polarity in the voice coil 116 is reversed relative to the audio signal polarity in the voice coil 136, as illustrated in FIG. 1 above. This arrangement results in the two earphones being actuated the same way, for the same audio signal.

Figure 3:
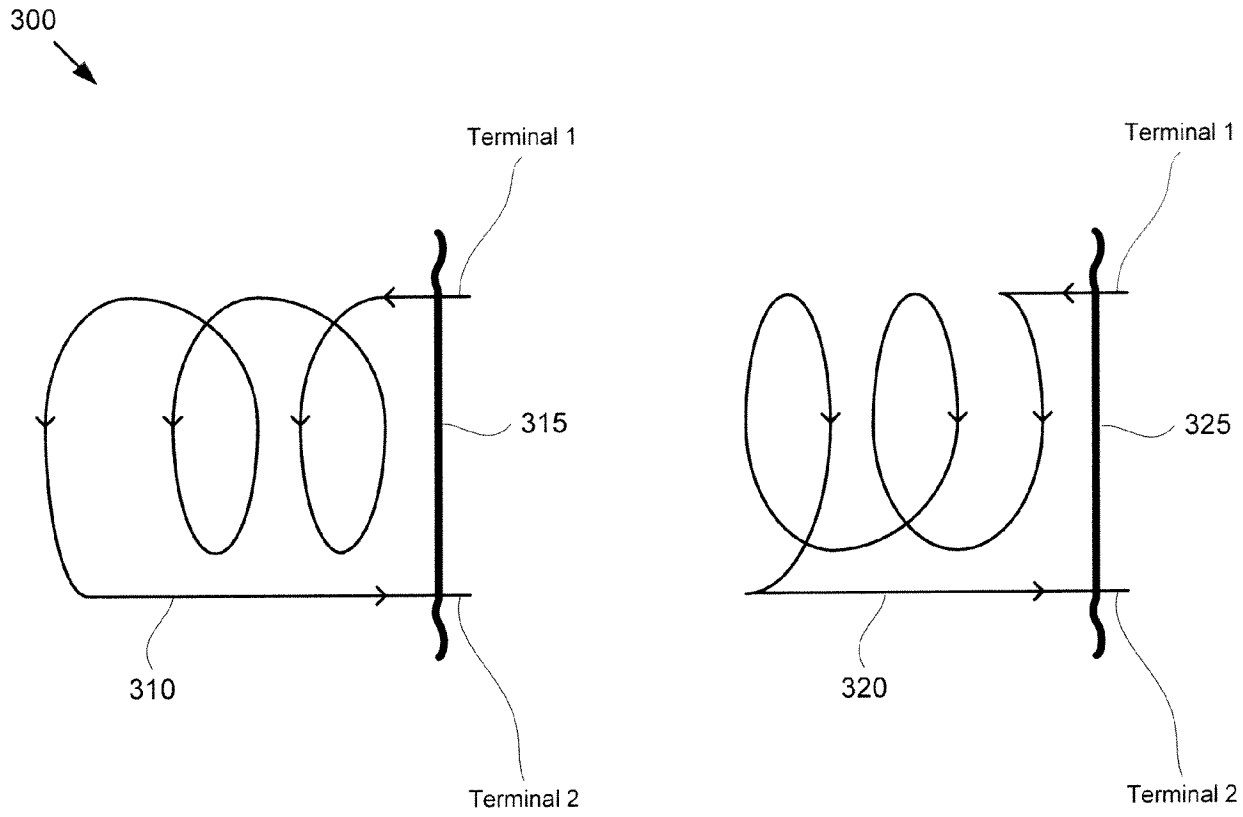
FIG. 3 illustrates two voice coils of an earphone system that have the same audio signal polarity but reversed direction of winding.

In an alternative embodiment, in order to have opposite polarity or current direction at the voice coil level, the audio signal connections to the terminals 1 and 2 can be the same for the voice coils 116 and 136, but the coil winding directions are reversed. FIG. 3 illustrates two voice coils of an earphone system that have the same audio signal polarity but reversed direction of winding in accordance with one embodiment of the present invention. Specifically, this figure shows two voice coils 310 and 320 of the earphone system 300. In one embodiment, the voice coil 310 resides in the earphone housing of one earphone of the earphone system 300 and the voice coil 320 resides in the earphone housing of another earphone of the earphone system 300. The voice coil 310 is affixed to a diaphragm 315 and the voice coil is affixed to a diaphragm 325.

The voice coils 310 and 320 have the same audio signal polarity, as illustrated by audio signal current flowing into the voice coils through terminal 1 and flowing out of the voice coils through terminal 2. However, the windings of the voice coils 310 and 320 are different. As illustrated in FIG. 3, the winding of voice coil 310 is in counter clockwise direction, while the winding of voice coil 320 is in clockwise direction.

Because of the reversed directions of winding for voice coils 310 and 320, the audio signal current flows in reversed directions in the voice coils. Therefore, the polarity of the magnetic field generated by the voice coils 310 and 320 are opposite to each other.

Figure 4:
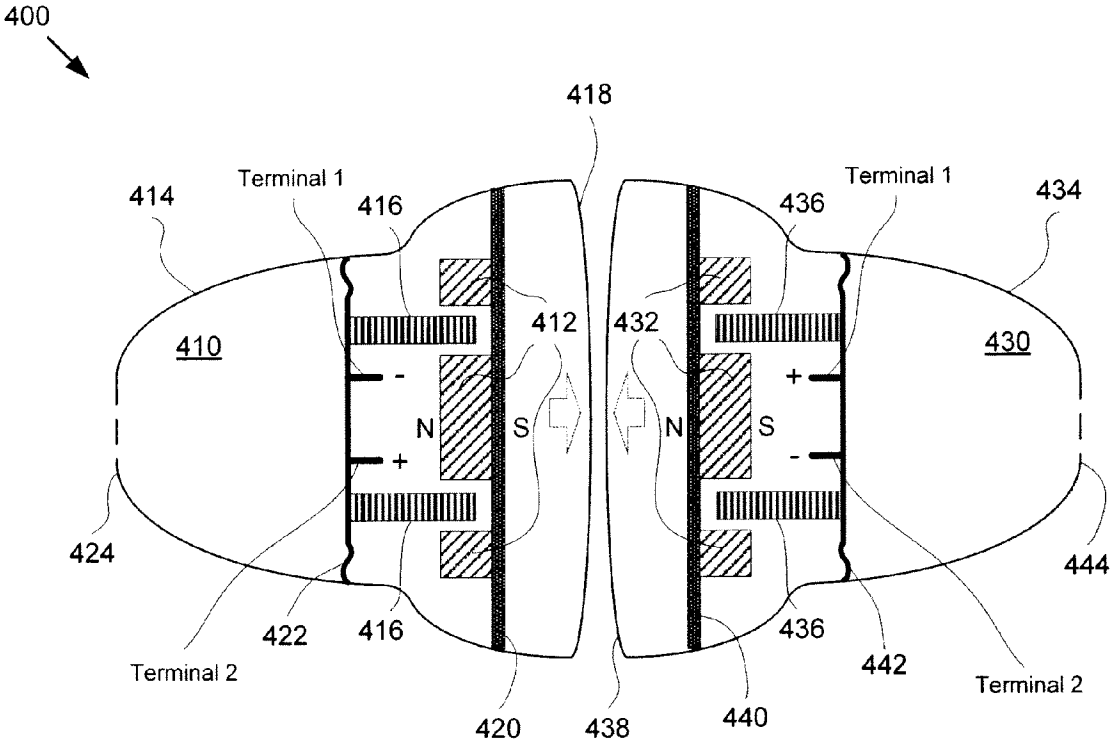
FIG. 4 illustrates the earphones of FIG. 1 in a back-to-back arrangement.

FIG. 4 illustrates a cross-sectional side view of the earphones of FIG. 1 in a back-to-back arrangement in accordance with another embodiment of the present invention. Specifically, this figure shows an earphone system 400 that includes a left earphone 410 and a right earphone 430. The back side 418 of the left earphone 410 is placed adjacent to the back side 438 of the right earphone 430. The arrangement of components in the earphone system 400 is similar to that of the earphone system 100 described in FIG. 1 above. However, the left earphone 410 and the right earphone 430 are placed back-to-back, rather than face-to-face as described in FIG. 1 above.

Because of the opposite magnetic polarity between the magnet assembly 412 of the left earphone 410 and the magnet assembly 432 of the right earphone 430, the left earphone 410 and the right earphone 430 attract each other when their back sides 418 and 438 are adjacent to each other, as illustrated in FIG. 4. The magnetic attraction between the left earphone 410 and the right earphone 430 could facilitate the storage of the left and right earphones as a combined unit. In one embodiment, in order to enhance the magnetic attraction between the left earphone 410 and the right earphone 430, the magnet assembly 412 is placed close to the back side 418 of the left earphone 410 and the magnet assembly 432 is placed close to the back side 438 of the right earphone 430.

One of ordinary skill in the art will recognize that the earphone systems 100 and 400 described in FIGS. 1, 2, and 4 are conceptual representations of an earphone system with left/right (L/R) magnetic asymmetry. The specific constructions and arrangements of the earphone systems 100 and 400 may not be limited to the exact way shown and described. For example, the magnet assembly and the voice coil may be configured differently in different embodiments. For example and in FIG. 1, terminal 1 of the left earphone 110 could connect to the positive side of the input audio signal and terminal 2 of the left earphone 110 could connect to the negative side, while terminal 1 of the right earphone 130 connects to the negative side of its input audio signal and terminal 2 connects to the positive side. In another example, in the left earphone 110, the south pole to north pole direction of the magnet assembly 112 could point to the back side 124, while in the right earphone 130, the south pole to north pole direction of the magnet assembly 132 could points to the front side 138. One of ordinary skill in the art will also recognize that, while the magnet systems shown in the FIGS. 1, 2, and 4 are part of an electro-dynamic (moving coil) driver, other earphone drivers (e.g., the planar magnetic earphone drivers) may be able to enjoy the benefit of the asymmetric magnet systems described.

Figure 5:
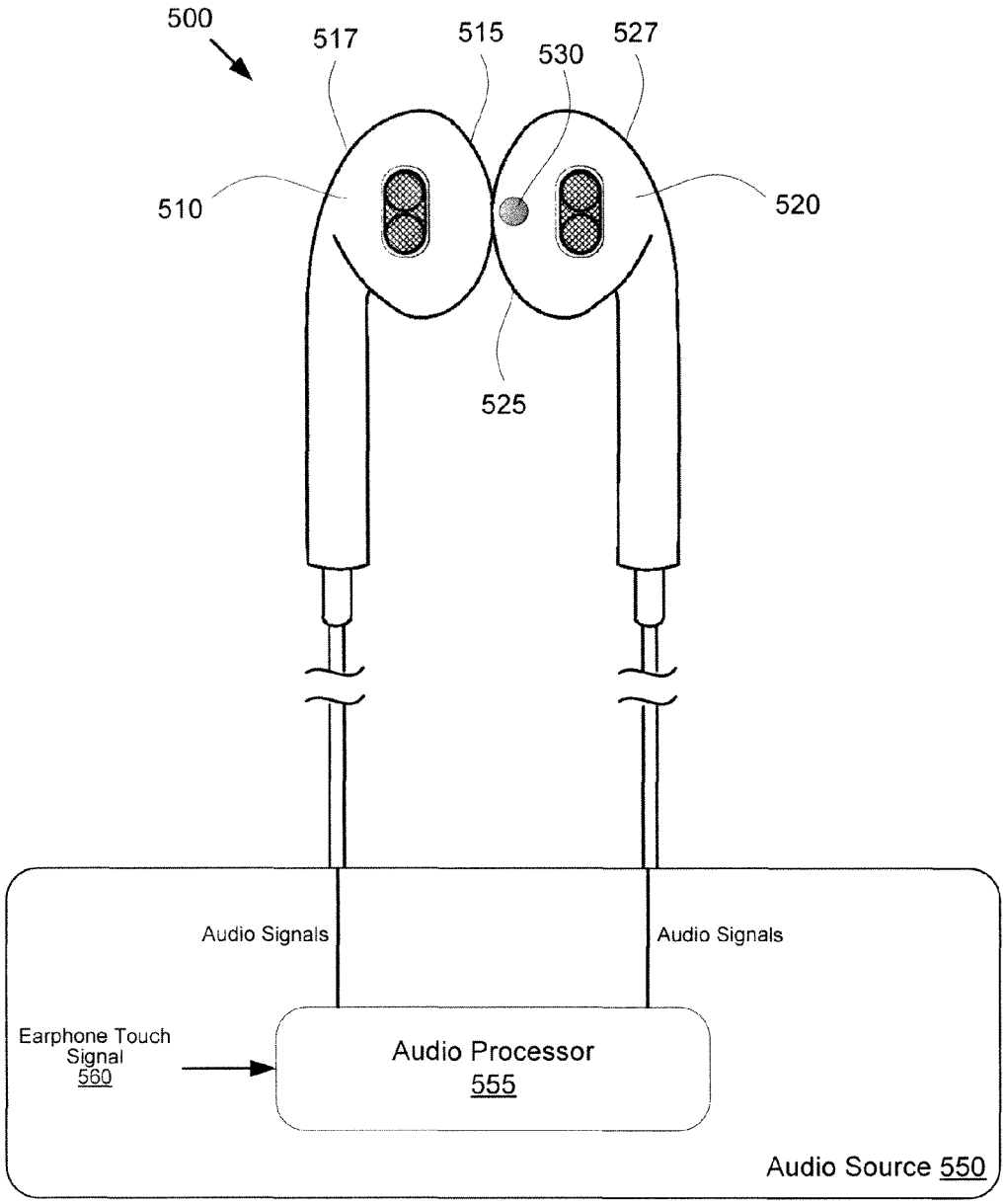
FIG. 5 illustrates a pair of asymmetrical magnetic polarity earphones with a built-in touch detector.

FIG. 5 illustrates a pair of asymmetrical magnetic polarity earphones with a built-in touch detector in accordance with one embodiment of the present invention. Specifically, this figure shows an earphone system 500 that includes a left earphone 510 and a right earphone 520. The front side 515 of the left earphone 510 touches the front side 525 of the right earphone 520 because of the magnetic attraction between the left earphone 510 and the right earphone 520. Some embodiments of an earphone system that may cause the magnetic attraction between the left earphone 510 and the right earphone 520 are described above in FIGS. 1-4.

The left earphone 510 and the right earphone 520 are connected to an audio source 550 in this example through a wire; although alternatively, the connection can be a wireless one. The audio source 550 provides the input audio signals to the earphones 510 and 520. In one embodiment, the audio source 550 includes an audio processor 555. The audio processor 555 generates audio signals that are transmitted to the earphones 510 and 520 and drive the speaker drivers inside of the earphones 510 and 520, respectively.

In the embodiment of FIG. 5, there is a touch detector 530 in the housing of the right earphone 520. The touch detector 530 sends an earphone touch signal 560 to the audio processor 555 through the wired connection or it may do so wirelessly. In one embodiment, the touch detector 530 is a physical mechanical switch that, when actuated by the housings of the left and right earphones coming together to touch each other (due to magnetic attractive forces discussed above), asserts the earphone touch signal 560 to the audio processor 555. In another embodiment, the touch detector 530 includes a reed switch that is operated by an applied magnetic field. For example, when the magnet of earphone 510 is placed close to the touch detector 530, the reed switch will change state (e.g., close) to assert the earphone touch signal 560 to the audio processor 555.

In one embodiment, the earphone touch signal 560 causes the audio processor 555 to be turned off which in turn may cause the audio processor 555 to cut off power to the audio signal amplifiers that may be inside the audio source 550 or inside the housings of the earphones 510 and 520. This will achieve the user's wish that once the earphones have been combined or joined into a single unit, they should be powered down.

One of ordinary skill in the art will recognize that the earphone system 500 described in FIG. 5 is a conceptual representation of an earphone system with L/R magnetic asymmetry. The specific constructions and arrangements of the earphone system 500 may not be limited to the exact way shown and described. For example, in FIG. 5, the touch detector 530 could be in the left earphone 510. Also, the touch detector 530 could alternatively be entirely inside the housing of the earphone and not visible from the outside. Also, instead of the front side 515 of the left earphone 510 touching the front side 525 of the right earphone 520, the earphones could be joined back-to-back, i.e., back side 517 of the left earphone 510 could touch the back side 527 of the right earphone 520, because of the magnetic attraction between the left earphone 510 and the right earphone 520.

While certain embodiments have been described and show in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. An earphone system comprising:

a first earphone comprising a first speaker driver having a first magnet assembly, a first coil, and a first diaphragm, wherein the first magnet assembly and the first coil work together to drive the first diaphragm;

a second earphone comprising a second speaker driver having a second magnet assembly, a second coil, and a second diaphragm, wherein the second magnet assembly and the second coil work together to drive the second diaphragm, wherein the second magnet assembly has a magnetic polarity that is opposite to that of the first magnet assembly; and a touch detector installed in one of the first or second earphones, to signal an audio source to turn off audio processing for the first and second speaker drivers in response to detecting that the left earphone and the right earphone are touching each other;

wherein the first and second earphones each have a symmetrical housing, each symmetrical housing having a) a front side that is positioned inside an ear of a user when the earphone is worn by the user and wherein the front side has openings through which sound produced by the diaphragm directly enters the ear canal of the user when the earphone is being worn by the user, and b) a back side that is outside of the ear when the earphone is worn by the user, wherein the magnet assembly and coil are installed inside the housing between the front and back sides thereof, and wherein the magnet assemblies of the first earphone and the second earphone attract each other so that the housings touch at their respective front sides, when the front side of the first earphone housing is placed close to the front side of the second earphone housing, and wherein the touch detector is installed in the housing and is closer to the front side than the back side.

2. The earphone system of claim 1, wherein current direction in the second coil is reversed relative to current direction in the first coil.

3. The earphone system of claim 2, wherein the first coil and the second coil have a same winding direction, wherein audio signal polarity in the first coil is reversed relative to audio signal polarity in the second coil.

4. The earphone system of claim 2, wherein the first coil and the second coil have reversed directions of winding.

5. The earphone system of claim 1, wherein the first magnet assembly is attached to a first stationary component of the first earphone and the second magnet assembly is attached to a second stationary component of the second earphone, wherein the first coil is affixed to the first diaphragm of the first earphone and the second coil is affixed to the second diaphragm of the second earphone.

6. The earphone system of claim 1, wherein the first earphone and the second earphone are to be connected to a same audio source.

7. An earphone system comprising:

a left earphone housing having a front side that is positioned inside an ear of a user when the earphone is worn b the user and wherein the front side has openings through which sound produced by a left diaphragm directly enters the ear canal of the user when the ea shone is being worn by the user, a back side that is outside of the ear when the earphone is worn by the user, and a left speaker driver therein;

a right earphone housing having a front side that is positioned inside an ear of a user when the earphone is worn by the user and wherein the front side has openings through which sound produced by a right diaphragm directly enters the ear canal of the user when the earphone is being worn by the user, a back side that is outside of the ear when the earphone is worn by the user, and a right speaker driver therein, wherein the left and right speaker drivers have respective magnet systems that are oriented with opposite polarity relative to each other when the housings are brought close to each other; and a touch detector installed in one of the left or right earphones, to signal an audio source to turn off audio processing for the left and right speaker drivers in response to detecting that the left earphone and the right earphone are touching each other;

wherein the magnet systems of the left and right speaker drivers attract each other so that the housings touch at their respective front sides, when the front side of the left earphone housing is placed close to the front side of the right earphone housing, wherein the touch detector is installed in the housing and is closer to the front side than the back side.

8. The earphone system of claim 7, wherein the left speaker driver and the right speaker driver are to be connected to a same audio source.

9. The earphone system of claim 7, wherein the touch detector comprises a mechanical switch to detect that the left earphone housing and the right earphone housing are in contact with each other.

10. The earphone system of claim 7, wherein the touch detector comprises a Reed switch in one of the left or right earphone housings to detect proximity of another one of the left or right earphone housings.

11. The earphone system of claim 9, wherein the left speaker driver in the left earphone housing comprises a left voice coil and the right speaker driver in the right earphone housing comprises a right voice coil, wherein current direction in the right voice coil is reversed relative to current direction in the left voice coil.

12. The earphone system of claim 11, wherein the left voice coil and the right voice coil have a same winding direction, and audio signal polarity in the left voice coil is reversed relative to audio signal polarity in the right voice coil.

13. The earphone system of claim 11, wherein the left voice coil and the right voice coil have opposite winding directions.

* * * * *